US007347198B2

(12) United States Patent
Freese et al.

(10) Patent No.: US 7,347,198 B2
(45) Date of Patent: Mar. 25, 2008

(54) OVEN RACK

(75) Inventors: T. Brent Freese, Newton, IA (US); Gary B. Jackovin, Ankeny, IA (US); Issac P. Sargunam, Cleveland, TN (US); Inho Andy Shin, Cleveland, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 349 days.

(21) Appl. No.: 10/803,914

(22) Filed: Mar. 19, 2004

(65) Prior Publication Data

US 2005/0204933 A1 Sep. 22, 2005

(51) Int. Cl.
*F24C 15/16* (2006.01)

(52) U.S. Cl. ..... 126/337 R; 211/153

(58) Field of Classification Search ..... 126/337 R, 126/332, 333, 337 A, 338, 339; 211/181.1, 211/153, 134; 312/280, 281, 351, 410
See application file for complete search history.

(56) References Cited

U.S. PATENT DOCUMENTS

| | | | | |
|---|---|---|---|---|
| 1,013,313 | A * | 1/1912 | Richardson | 126/339 |
| 1,343,818 | A | 6/1920 | Grammich | |
| 1,350,330 | A | 8/1920 | Partonnar | |
| 1,544,920 | A | 7/1925 | Manley et al. | |
| 1,925,371 | A | 9/1933 | Charter | |
| 2,169,904 | A * | 8/1939 | Schweller | 211/153 |
| 3,012,554 | A * | 12/1961 | Hirsch | 126/338 |
| 3,450,025 | A * | 6/1969 | Fleming | 312/351 |
| 3,791,371 | A | 2/1974 | Oatley | |
| 3,977,389 | A * | 8/1976 | Ondrasik, II | 126/337 R |
| 5,447,146 | A * | 9/1995 | Nickerson | 126/339 |
| 6,030,059 | A | 2/2000 | Stravitz | |
| 6,112,916 | A | 9/2000 | Barnes et al. | |
| 6,148,813 | A | 11/2000 | Barnes et al. | |
| 6,205,997 | B1 | 3/2001 | Bartley | |
| D442,432 | S | 5/2001 | Bartley | |
| D444,997 | S | 7/2001 | Bartley | |
| D445,302 | S | 7/2001 | Bartley | |
| 6,644,302 | B1 * | 11/2003 | Bartley | 126/337 R |

FOREIGN PATENT DOCUMENTS

| | | | |
|---|---|---|---|
| DE | 40 14 823 | A1 * | 11/1991 |
| GB | 827796 | A * | 2/1960 |

* cited by examiner

*Primary Examiner*—Josiah C. Cocks
(74) *Attorney, Agent, or Firm*—Michael D. Lafrenz; John Morrison

(57) ABSTRACT

An oven rack for supporting food items to be cooked in a oven cavity of an appliance includes a frame portion and a support platform defined by a plurality of support members that establish a food item support zone and a food item access zone. The plurality of support members include substantially straight support members and offset or shaped support members. The offset support members, in combination with a vertically offset section of the frame portion, define the food item access zone which is vertically offset from the food item support zone so as to enable a consumer to access a bottom portion of a food item resting on the rack.

19 Claims, 7 Drawing Sheets

OVEN RACK

BACKGROUND OF THE INVENTION

1. Field of the Invention

The present invention pertains to the art of cooking and, more specifically, to a rack configured to enhance access and manipulation of products resting upon the rack within an oven cavity.

2. Discussion of the Prior Art

Typically, cooking appliances designed for household use are provided with one or more racks for supporting food items to be cooked within an oven cavity. The oven cavity itself is generally provided with a plurality of vertically spaced side wall rails for supporting respective lateral sides of the rack, while permitting the rack to be vertically adjusted. That is, the rack can slide along a selected set of support rails for movement into and out of the oven cavity, with the rack also being removable for cleaning or for repositioning at a different height.

Oven racks are often of wire frame construction. More specifically, a typical oven rack would be defined by an outer wire frame and a support platform constituted by a plurality of fore-to-aft extending and laterally spaced wires. Typically, the wires are substantially evenly spaced across the entire rack and extend in a common plane so as to define a platform for use in supporting food items in the oven cavity.

During a cooking operation, a food item may need to be repositioned on a rack. That is, in order to ensure even heating, the food item, which is either directly supported on the rack or arranged on a tray, pan or dish placed on the rack, must be rotated or otherwise shifted on the rack. During a repositioning operation, the rack itself can interfere with the easy manipulation of the food item. For example, it may be desired to rotate or remove a pie from an oven cavity. In doing so, it would be advantageous to have ready access to a bottom portion of the pie so that contact with the crust can be avoided and the contents of the pie left substantially undisturbed. Without access to the bottom of the pie pan, it may become necessary to tilt the pie, which can result in spilling or otherwise disturbing the contents of the pie, or damage to the crust by gripping upper portions of the pie.

Another example would be the need to remove or manipulate a large roasting pan. In this situation, the rack must either be withdrawn from the oven to gain clear access to handles located on side portions of the pan or the pan must be shifted by pushing/pulling side portions thereof. Given the thin profile of oven racks, grasping and shifting the oven rack out of the oven cavity can be difficult. This problem is exacerbated by the need to wear oven mitts that generally do not allow a great deal of tactile manipulation. Likewise, gripping internal portions of the pan is also difficult. The size, thickness, and lack of mobility can make gripping inside portions of a pan, particularly with oven mitts, tricky and often times an awkward endeavor.

Based on the above, there exists a need in the art for an oven rack constructed in a manner which enhances a consumer's ability to readily access a food item being cooked upon the rack in an oven. U.S. Pat. No. 6,205,997 discloses an oven rack which addresses this concern by providing the rack with a frontal notch. The notch is arranged in the plane of the oven rack to provide some enhanced access from beneath items traversing the notch. Regardless of the known prior art, there is still seen to exist a need in the art for an oven rack that enables a consumer to more readily access lower portions of a food item to facilitate manipulation of the food item relative to the oven rack, while preferably also providing for enhanced gripping or engaging of the oven rack for sliding movement into and out of the oven cavity as desired.

SUMMARY OF THE INVENTION

In accordance with the present invention, a rack for supporting food items to be cooked in an oven cavity of an appliance is designed to have a food item support zone and a food item access zone. Each of the zones is defined by a plurality of spaced support elements and a frame portion of the rack. More specifically, the frame portion includes front, rear and opposing side rods, with the front rod including at least one vertically offset portion. The plurality of spaced support elements include both uninterrupted or substantially straight support members, as well as offset or shaped members. The offset or shaped members, together with the vertically offset portion, combine to define the food item access zone.

In accordance with the most preferred forms of the invention, the rack is constructed of wire with the food item access zone is vertically offset from the food item support zone. Actually, the oven rack can be provided with one or more food item access zones. In any event, this arrangement allows a consumer to readily access a bottom surface of a food item to enable easy manipulation while the food item is supported on the rack. In addition, the food item access zone(s) defines a handle region which can be grasped or otherwise engaged to shift the oven rack relative to the oven cavity from a position located below a plane of the food item support zone.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
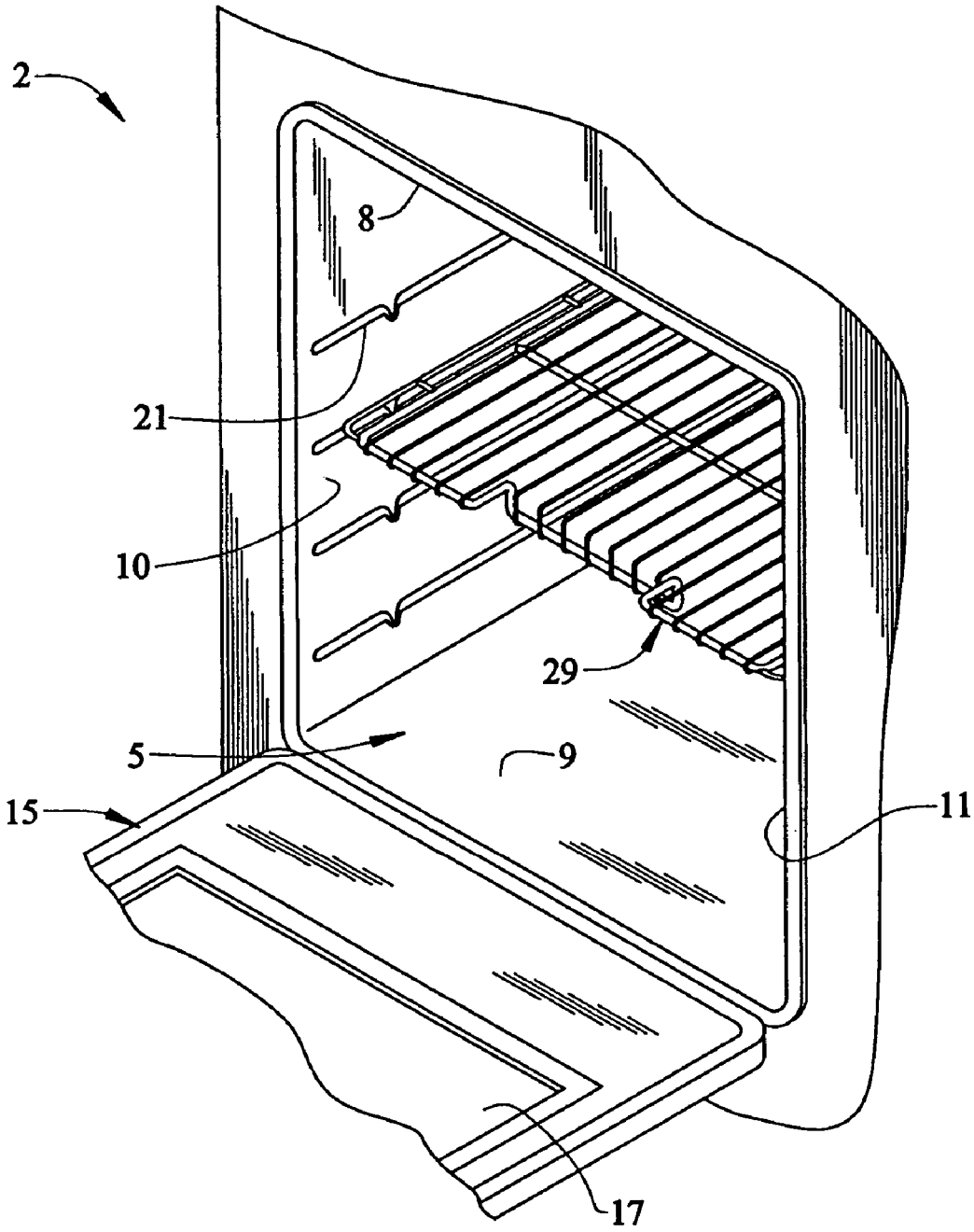
FIG. 1 is a partial perspective view of an oven cavity incorporating a rack constructed in accordance with a first preferred embodiment of the invention.

With initial reference to FIG. 1, a cooking appliance 2 is generally shown to include an oven cavity 5. Oven cavity 5 is defined by top, bottom and opposing side walls 8-11 as well as a rear wall (not shown). In a manner known in the art, oven cavity 5 is adapted to be selectively closed by means of a door 15 that is illustrated to include a tempered glass section or window 17. As various types of heating sources can be utilized in connection with the invention, no particular heating element is illustrated in this figure. That is, cooking appliance 2 can be heated by gas, electric, convection and/or microwave heating techniques. In addition, cooking appliance 2 can be constituted by a range, slide-in unit, wall oven or the like.

In a manner known in the art, side walls 10 and 11 are preferably provided with a plurality of fore-to-aft extending and vertically spaced rails, one of which is indicated at 21. Rails 21 are arranged as associated pairs on side walls 10 and 11 in order to support an oven rack 29 that extends across substantially the entire width of oven cavity 5. With this construction, rack 29 can be supported upon any selected pair of rails 21 such that rack 29 can assume various vertical positions within oven cavity 5. As the manner in which rack 29 is supported for movement relative to oven cavity 5 is widely known in the art and not considered part of the present invention, it will not be discussed further herein. Instead, the present invention is particularly directed to various preferred oven rack configurations as will be detailed more fully below with particular reference to FIGS. 2-7.

Figure 2:
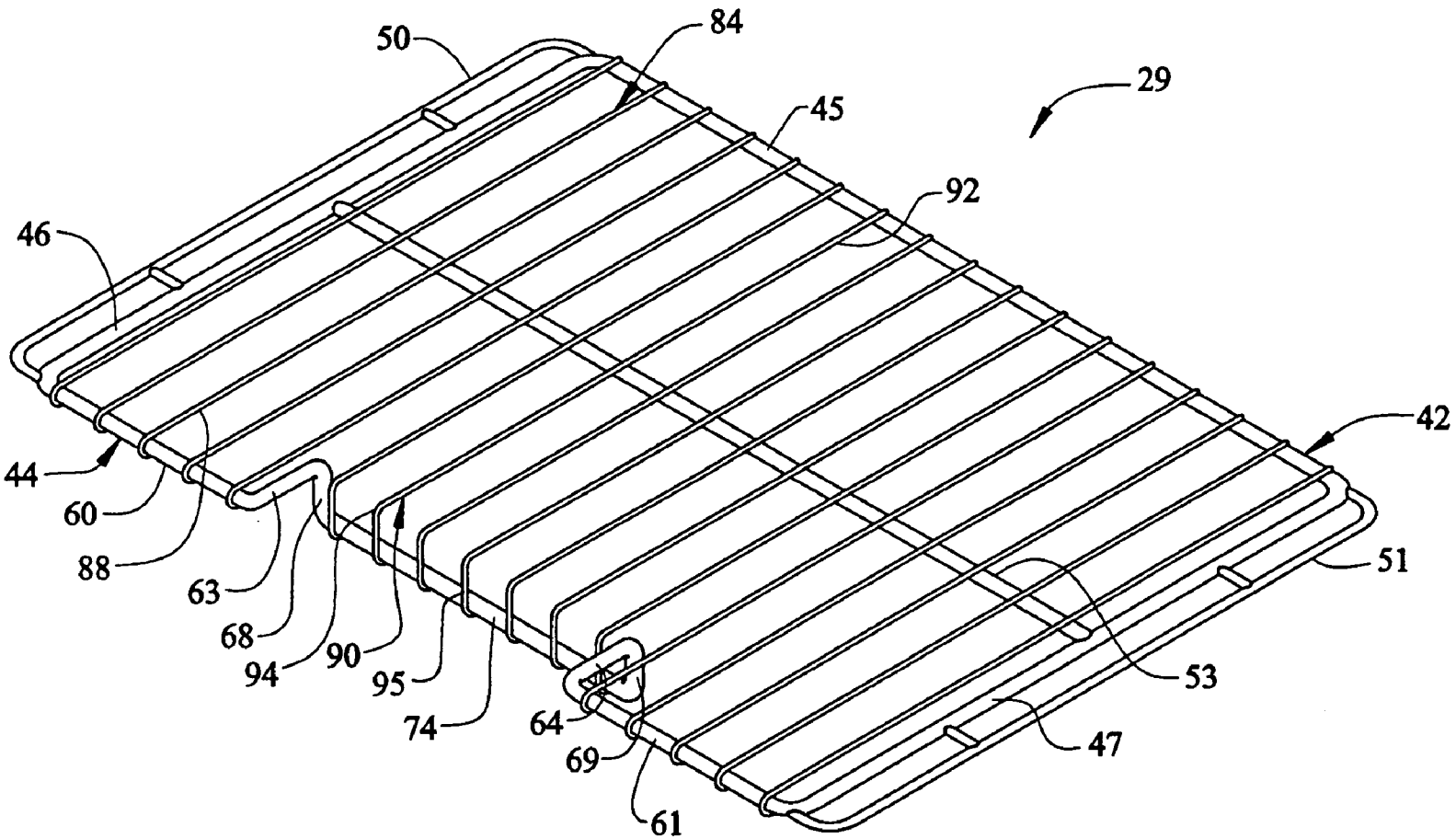
FIG. 2 is a upper right perspective view of the rack of FIG. 1.

In accordance with one embodiment of the present invention as shown in FIG. 2, oven rack 29 has a wire construction and includes a frame portion 42 defined by front, rear and opposing side rods 44-47. Preferably frame portion 42 is formed from bending a single metal bar to form each of the front, rear and opposing side rods 44-47. In the embodiment shown, each side rod 46, 47 is provided with a corresponding guide rail 50, 51 for supporting rack 29 on rack support rails 21 in oven cavity 5. As further shown in this figure, rack 29 is provided with a cross rod 53 that serves as a stiffener to enable the supporting of rather large and/or heavy food items.

In accordance with the embodiment shown, front rod 44 includes first and second frontal segments 60 and 61 which respectively lead to first and second in-turned segments 63 and 64. As depicted, first and second in-turned segments 63 and 64 are preferably equally spaced from corresponding side rods 46 and 47. In-turned segments 63 and 64 lead to respective first and second down-turned segments 68 and 69 that are interconnected by a vertically offset portion 74. With this construction, vertically offset portion 74 is spaced rearward of first and second frontal segments 60 and 61 such that a food item access zone (not separately labeled) is defined between in-turned segments 63 and 64. That is, this arrangement defines a food item access zone at the front of rack 29. A food item supported upon rack 29 can extend across the food item access zone in order to be accessed from below as will be discussed further hereinafter. In addition to providing unfettered access to a bottom portion of a food item, vertically offset portion 74 can be used as a handle to facilitate sliding or shifting of rack 29 into and out of oven cavity 5 on support rails 21.

In addition to frame portion 42, rack 29 includes a support platform, generally indicated at 84, that defines a food item support zone (not separately labeled). In any event, support platform 84 is constituted by a plurality of support members 88 and 90 in the form of elongated wires. Actually, in the embodiment shown, support platform 84 includes a first plurality of uninterrupted or straight support members 88 that extend fore-to-aft between a respective one of first and second frontal segments 60 and 61 and rear rod 45, as well as a plurality of offset or shaped support members 90 that extend from rear rod 45 to vertically offset portion 74. More specifically, offset or shaped support member 90 includes a fore-to-aft extending portion 92, a bend portion 94, and an angled portion 95. Angled portion 95 preferably projects substantially perpendicular to fore-to-aft extending portion 92 and interconnects with vertically offset portion 74. The support members 88 and 90 are preferably joined to frame portion 42 through, for example, welding.

With this particular arrangement, a consumer can place a food item on rack 29 with a portion of the food item extending into the food item access zone defined in front of support members 90. Thereafter, the consumer can access a bottom portion of the food item through the food item access zone defined between in-turned segments 63 and 64 and in front of offset section 74. Typically, the food item is supported in a pan, thus the present invention allows the pan to be accessed and lifted from the bottom. Therefore, to remove the food item from oven cavity 5, the consumer need not tilt or otherwise excessively disturb the contents of the food item, but rather the food item can be shifted and lifted from below. In addition, lifting from the bottom allows for a more stable manipulation of the food item. As indicated above, offset section 74, which is arranged below a plane defined by support members 88 and portions 92 of support members 90, can also be conveniently used as a handle for shifting oven rack 29 into and out of oven cavity 5.

Figure 3:
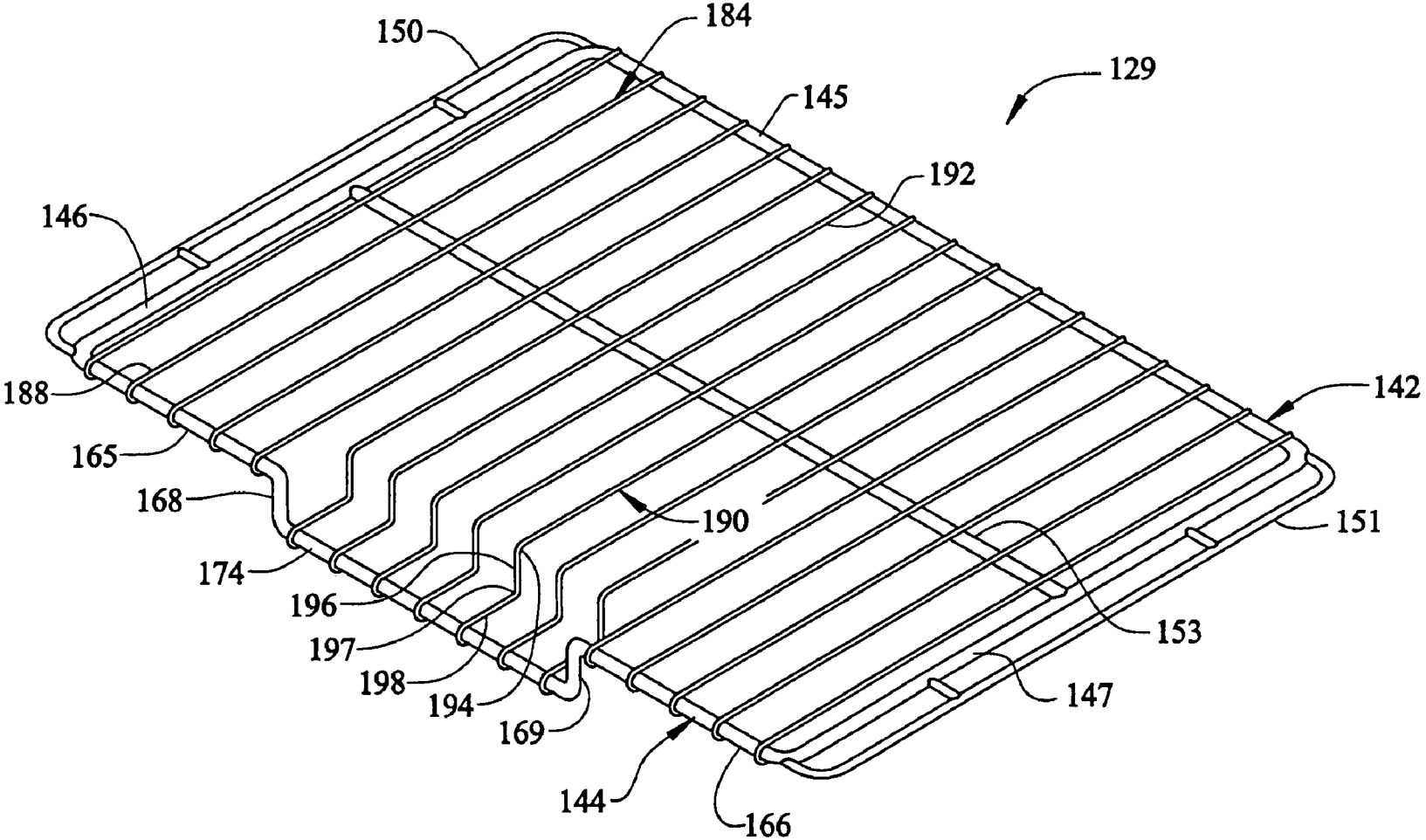
FIG. 3 is an upper right perspective view of a rack constructed in accordance with a second embodiment of the present invention.

In accordance with the invention, the food item access zone can be defined in various ways. In a second embodiment of the present invention as represented in FIG. 3, a rack 129 is constructed in a manner similar to that described above with respect to rack 29. That is, rack 129 includes a frame portion 142 defined by front, rear and opposing side rods 144-147 preferably formed from bending a single metal bar. In addition, each side rod 146 and 147 is provided with a corresponding guide rail 150, 151 for slidably supporting rack 129 in oven cavity 5. Also shown in FIG. 3, rack 129 is provided with a cross rod 153 that increases the support capabilities of rack 129.

In accordance with this embodiment, front rod 144 of rack 129 is provided with first and second frontal segments 165 and 166, as well as first and second down-turned segments 168 and 169 that are interconnected by a vertically offset portion 174. As will be detailed more fully below, vertically offset portion 174 defines, in part, the food item access zone (not separately labeled) that enables the consumer to readily remove or manipulate a food item supported on rack 129 in oven cavity 5.

In addition to frame 142, rack 129 includes a support platform 184 which is constituted by a plurality of support members in the form of straight or uninterrupted support members 188 and offset or shaped support members 190. Each shaped support member 190 extends from rear rod 145 through a first fore-to-aft extending portion 192 to a position short of front rod 144. At this point, each shaped support member 190 is provided with a substantially perpendicular bend portion 194 that leads to an angled portion 196. Angled portion 196 extends through a second substantially perpendicular bend portion 197 toward a horizontal, offset portion 198 that is joined to vertically offset portion 174. In accordance with the embodiment shown, offset portion 198 extends less than one-quarter of the depth of rack 129. In any event, rack 129 is provided with a food item access zone, which is arranged below a plane defined by support members 188 and portions 192 of support members 190, in front of angled portions 196, between first and second down-turned segments 168 and 169 and above offset portions 198, that enables a consumer to gain access to a bottom portion of a food item supported on rack 129 in oven cavity 5. Furthermore, offset portion 174 and/or angled portions 196 can be used to readily shift rack 129 into and out of oven cavity 5.

Figure 4:
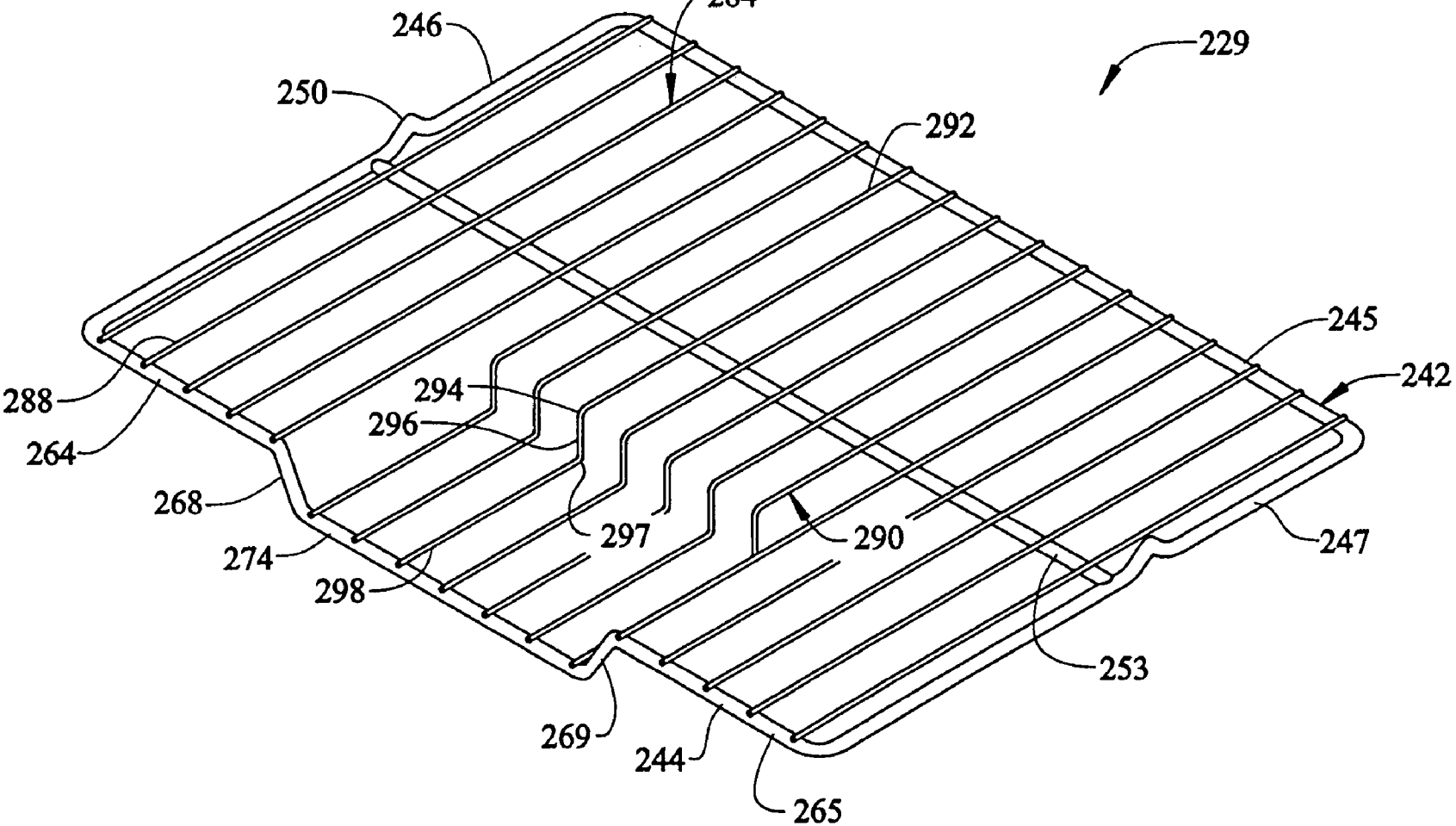
FIG. 4 is an upper right perspective view of a rack constructed in accordance with a third embodiment of the present invention.

A third embodiment of the present invention illustrated in FIG. 4. This embodiment is quite similar to that of FIG. 3, while including a deeper or enlarged food item access zone. In this embodiment, a rack 229 includes a frame portion 242 defined by front, rear and opposing side rods 244-247. Each side rod 246, 247 is preferably formed with an upstanding section 250 spaced rearward of front rod 244. Upstanding section 250 is adapted to cooperate with structure (not labeled) formed on rails 21 to limit the degree of travel of rack 229 into and out of oven cavity 5. In general, this interaction between rack 229 and oven cavity 5 is known in the art and thus not considered part of the present invention so that further discussion thereof will not be made here. In a manner analogous to that described above with reference to racks 29 and 129, rack 229 is provided with a cross rod 253 that increases the overall carrying capacity of rack 229. Furthermore, front rod 244 of rack 229 includes first and second frontal segments 264 and 265 leading to first and second down-turned segments 268 and 269 that are interconnected to a vertically offset portion 274.

In addition to frame portion 242, oven rack 229 includes a support platform 284 having a plurality of zones. That is, in a manner corresponding to that described above, support platform 284 includes a food item support zone and a food item access zone. Toward that end, support platform 284 is constituted by a plurality of support members in the form of straight, uninterrupted support members 288 and a plurality of offset or shaped support members 290. Each offset support member 290 extends from rear rod 245 across support platform 284 through a first fore-to-aft extending portion 292 to a position spaced from front rod 244. At this point, a substantially perpendicular bend portion 294 is formed in each offset support member 290. Each bend portion 294 leads to a respective angled portion 296 that transitions into a second substantially perpendicular bend portion 297. Bend portion 297 leads into a second fore-to-aft extending or offset portion 298 that is joined to vertically offset portion 274. In accordance with this particular embodiment, the food item access zone defined by offset portions 298 is arranged below the food item support zone defined by first fore-to-aft extending portions 292. Therefore, the food item access zone constitutes a vertically offset region of support platform 284 having a depth that extends from front rod 244 about one-third of the entire depth of rack 229. In other words, offset portion 298, in combination with vertically offset portion 274, define the food item access zone that enables a consumer to readily lift a food item from rack 229 without tilting or otherwise disturbing the food item. In addition, due to the depth of the food item access zone, a consumer can easily insert a utensil, such as a pizza paddle or spatula, under the food item in order to shift or otherwise manipulate the food item relative to rack 229.

Figure 5:
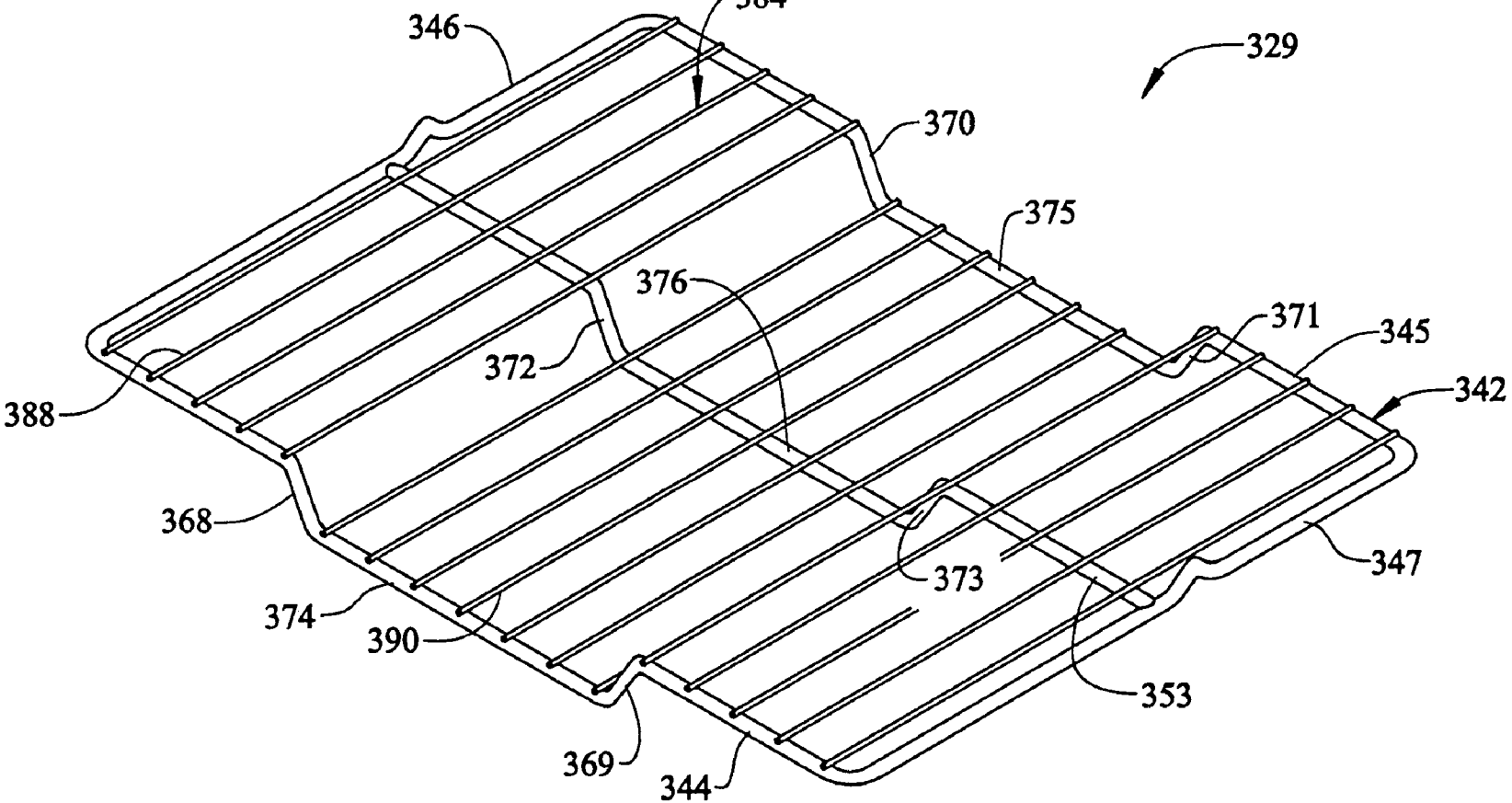
FIG. 5 is an upper right perspective view of a rack constructed in accordance with a fourth embodiment of the present invention.

In accordance with the embodiment shown in FIG. 5, the food item access zone has been increased in depth verses that of the FIG. 4 embodiment. That is, a rack 329 is shown to include first and second food item support zones that are laterally spaced by a food item access zone extending the entire depth of rack 329. More specifically, rack 329 is provided with a frame portion 342 defined by front, rear and opposing side rods 344-347. In a manner similar to that described above, rack 329 is provided with a cross rod 353 that increases the overall support capacity of the food item support zones.

In accordance with the present embodiment, front rod 344 includes first and second down-turned segments 368 and 369. However, as the food item access zone extends the entire depth of rack 329, rear rod 345 and cross rod 353 are provided with corresponding down-turned segments 370, 371 and 372, 373 respectively. Each of the down-turned segments 368-373 are interconnected by corresponding vertically offset sections 374-376. In a manner analogous to each of the previous embodiments, rack 329 also includes a support platform 384. However, in accordance with the present invention, support platform 384 includes a plurality of support members in the form of straight, preferably uninterrupted members 388 that extend between front rod 344 and rear rod 345 in areas adjacent side rods 346 and 347. Support platform 384 further includes plurality of offset support members 390 that extend across and interconnect each of the vertically offset portions 374-376 of frame portion 342. With this particular arrangement, a consumer can place a food item upon the laterally spaced food item support zones, with the food item extending above and across the food item access zone. In a manner corresponding to the above-described embodiments, this arrangement of an upper food item support zone and a lower food item access zone enables supported food items to be readily removed, rotated or shifted, either by hand or through the use of a utensil. In addition, a lower portion of rack 329 is established which can be used as a manipulating handle.

Figure 6:
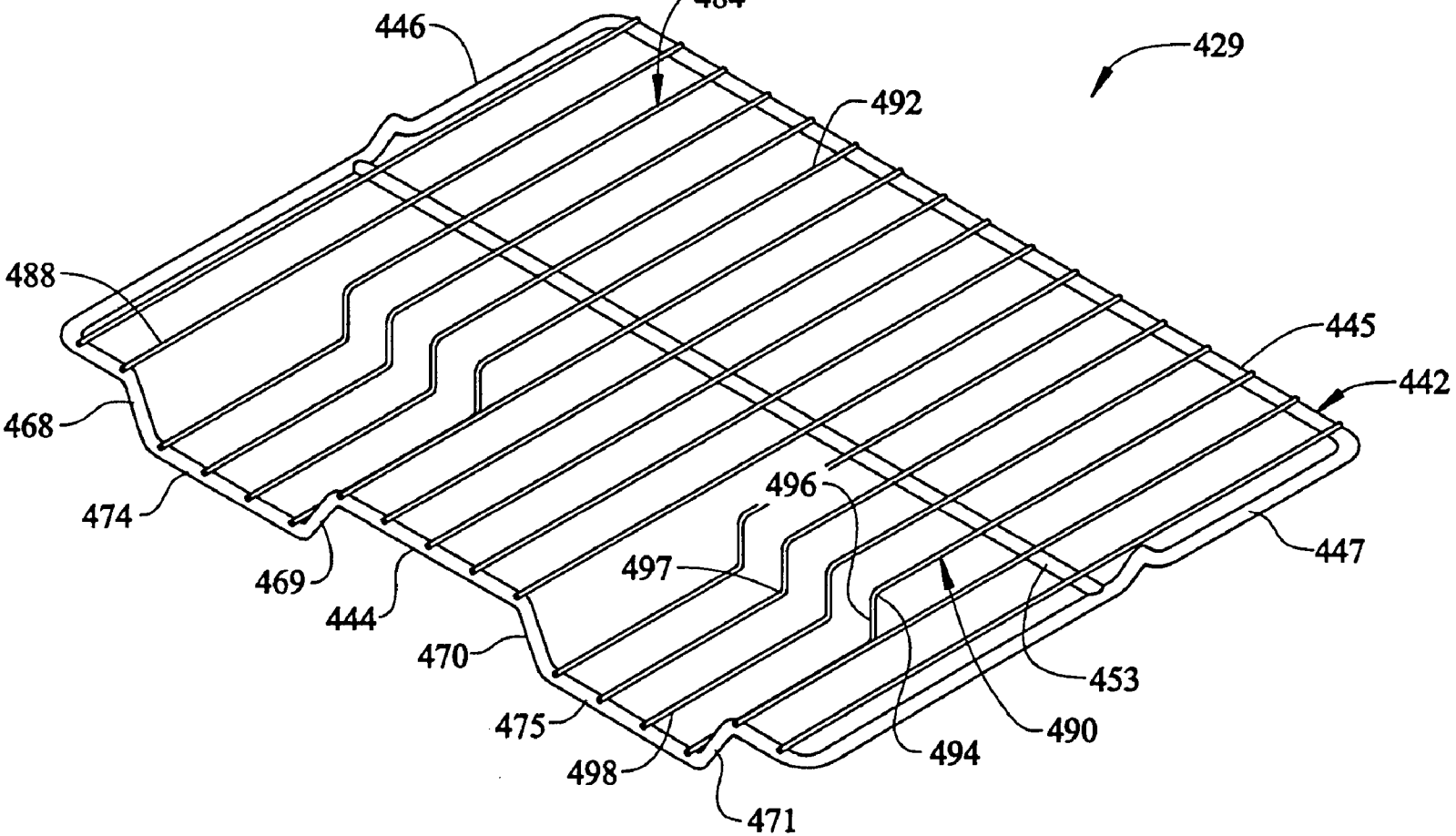
FIG. 6 is an upper right perspective view of a rack having multiple food item access zones in accordance with a fifth embodiment of the present invention.

In accordance with still another embodiment of the present invention as shown in FIG. 6, a rack 429 includes first and second laterally spaced food item access zones. To this end, rack 429 includes a frame portion 442 defined by front, rear and opposing side rods 444-447. In a manner similar to that described above, rack 429 is provided with a cross rod 453 which serves to increase the overall support capability of rack 429. More importantly, given that rack 429 is provided with two food item access zones, front rod 444 includes first, second, third and fourth down-turned segments 468-471, which are interconnected by respective vertically offset sections 474 and 475. As will be detailed more fully below, each vertically offset portion 474, 475 enables a consumer reach in under one or more food items supported upon rack 429 to rotate, shift or otherwise manipulate the food item. More specifically, the present invention enables the consumer to use both hands to access and manipulate the food item.

In a manner similar to that described above, oven rack 429 includes a support platform 484 defined by a plurality of support members in the form of uninterrupted or straight support members 488 and offset support members 490. Each offset support member 490 extends from rear rod 445 through a first fore-to-aft extending section 492 to a position spaced from front rod 444. At this point, first section 492 is provided with a substantially perpendicular bend portion 494 that leads to an angled portion 496. Thereafter, angled portion 496 extends through a second substantially perpendicular bend portion 497 to an offset portion 498 which is interconnected with a respective one of vertically offset sections 474 and 475 of front rod 444. In any case, as clearly shown in FIG. 6, rack 429 includes two vertically offset food item access zones. With this arrangement, a consumer can lift, with both hands, a food item, such as a large roasting pan or the like, extending across rack 429, while having available various lower level handle structures for manipulating the overall rack 429.

Figure 7:
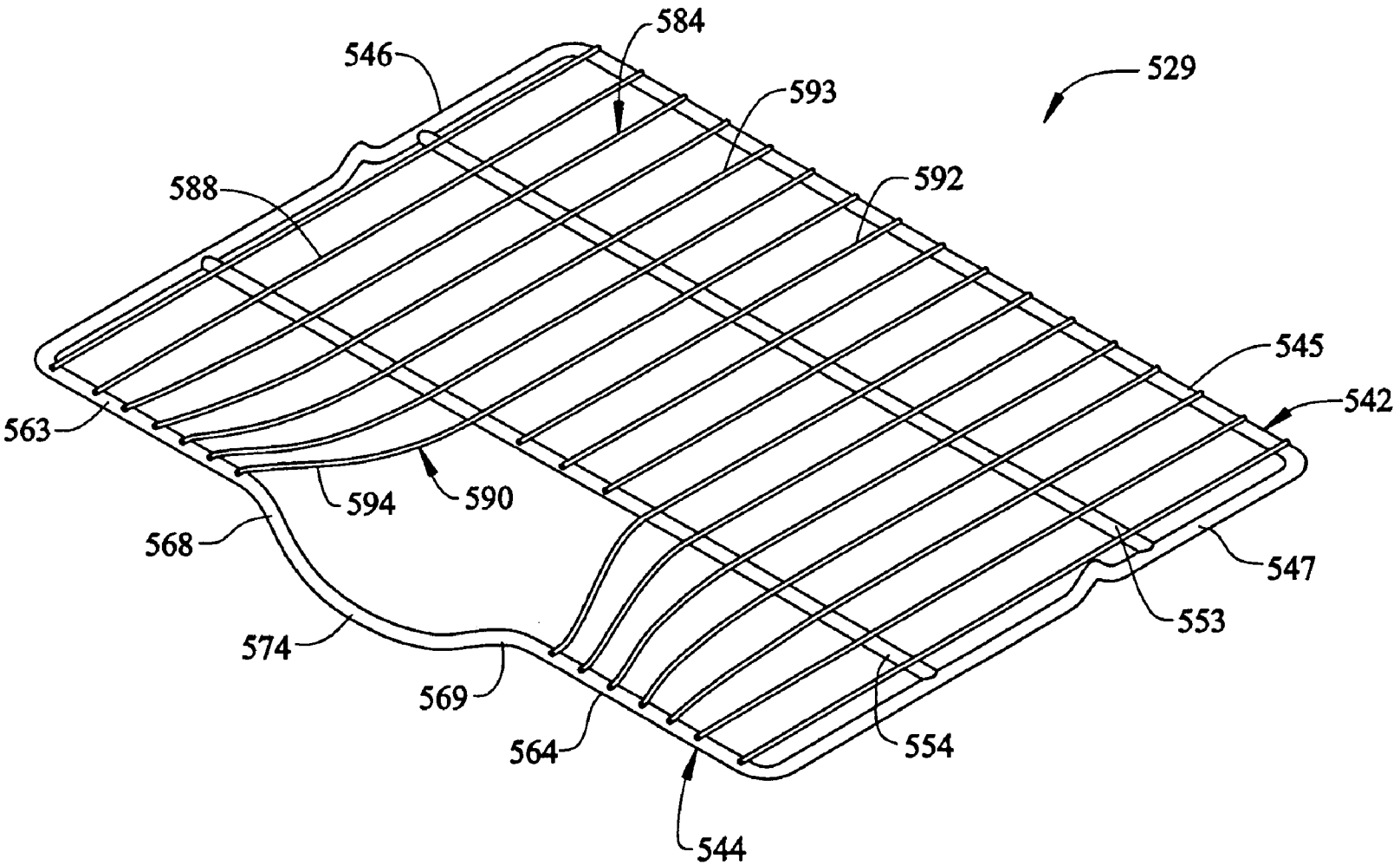
FIG. 7 is an upper right perspective view of a rack constructed in accordance with a sixth embodiment of the present invention.

In accordance with yet another embodiment of the present invention as shown in FIG. 7, an oven rack 529 includes a food item access zone constituted by an offset defined void formed at a front portion of rack 529. That is, rack 529 includes a frame portion 542 defined by front, rear and opposing side rods 544-547. As shown, side rods 546 and 547 are interconnected by first and second, fore-to-aft spaced cross rods 553 and 554. Front rod 544 includes first and second frontal segments 563 and 564, as well as first and second down-turned segments 568 and 569 which are preferably equally spaced from side rods 546 and 547 respectively. Down-turned segments 568 and 569 are interconnected through a vertically offset portion 574 which, in the preferred embodiment shown, is defined by an elongated curved portion of front rod 544. With this arrangement, in addition to enabling access to lower portions of a food item resting upon oven rack 529, vertically offset portion 574 can conveniently serve as a handle to facilitate the insertion and removal of oven rack 529 from oven cavity 5.

In addition, oven rack 529 includes a support platform 584 defined by a plurality of elongated straight support members 588 and elongated offset or shaped support members 590 extending from rear rod 545 to front rod 544. Support platform 584 further includes a plurality of shorter support members 592 that extend from rear rod 545 and terminate at cross rod 554. As shown, each offset or shaped support member 590 preferably extends from rear rod 554 through a first elongated section 593 to second cross rod 554. At the junction with second cross rod 554, each offset or shaped support member 590 is formed with a bend portion 594 that leads to and joins front rod 554. Thus, as clearly shown in FIG. 7, support members 590, in combination with shorter support members 592, a portion of second cross rod 554 and vertically offset portion 574, define a food item access zone in a front portion of support platform 584.

Based on the above description of preferred embodiments, it should be clear that the oven rack of the invention establishes an upper food item support zone and a lower food item access zone in order to enable a consumer to gain enhanced access to a lower portion of a food item supported on the rack, typically through the use of a pan or the like. By providing access to a lower portion of the food item, a consumer can readily remove, rotate or otherwise shift the food item in oven cavity 5 without tilting or otherwise disturbing the food item, e.g., the contents of the pan, during a cooking operation. In addition, the portion of the rack which is below a plane of the food item support zone advantageously enables the rack itself to be readily grasped and manipulated.

Although described with reference to a preferred embodiment of the present invention, it should be readily apparent to one of ordinary skill in the art that various changes and/or modifications can be made to the invention without departing from the spirit thereof. For instance, various other rack materials and geometries could be employed while maintaining some form of vertically offset frontal rack section designed to facilitate access to a food item and manipulation of the rack. In general, the invention is only intended to be limited to the scope of the following claims.

We claim:

1. An oven rack for supporting a food item to be cooked in a oven cavity of an appliance comprising:

a frame portion including front, rear and opposing side rods, said front rod including first and second down-turned segments that are joined by a vertically offset portion; and a support platform including a first plurality of spaced support members and a second plurality of spaced support members which are configured different from the first plurality of spaced support members, each of the first and second plurality of spaced support members extending between and being fixed to the front and rear rods to establish a food item support zone, with the second plurality of spaced support members extending through a bend portion that is spaced from said front rod to define a food item access zone, said food item access zone being defined at the vertically offset portion to provide for exposure of a bottom portion of a food item placed upon the rack for cooking.

2. The oven rack according to claim 1, wherein the food item access zone is established vertically below a plane defined by the food item support zone.

3. The oven rack according to claim 1, wherein the first plurality of spaced support members extend in a common plane between the front and rear rods, and the second plurality of support members extend from the rear rod through the bend portion to join the vertically offset portion.

4. The oven rack according to claim 3, wherein each of the second plurality of support members further includes an offset portion leading from the bend portion to the vertically offset portion.

5. The oven rack according to claim 4, wherein the offset portion of each of the second plurality of support members extends in a plane which is vertically below the common plane.

6. The oven rack according to claim 4, wherein the offset portion of each of the second plurality of support members extends less than one-half a depth of the support platform.

7. The oven rack according to claim 6, wherein the offset portion of each of the second plurality of support members extends less than one-quarter a depth of the support platform.

8. The oven rack according to claim 1, wherein the front rod also includes first and second frontal segments arranged laterally outwardly of the vertical offset portion.

9. The oven rack according to claim 8, wherein said bend portion at least partially defines the food item access zone and is directly joined to one of the first and second frontal segments.

10. The oven rack according to claim 8, wherein each of the first and second down-turned segments is spaced from a respective one of the opposing side rods.

11. The oven rack according to claim 10, further comprising: first and second in-turned segments formed in the front rod, each of said first and second in-turned sections leading from a respective one of the first and second frontal segments to a respective one of the first and second down-turned segments.

12. The oven rack according to claim 1, wherein the vertically offset portion establishes a handle adapted for use in shifting the oven rack relative to an oven cavity.

13. The oven rack according to claim 12, wherein the vertically offset portion is located centrally along the front rod.

14. The oven rack according to claim 1, wherein the support platform includes first and second, distinct food item access zones.

15. The oven rack according to claim 1, further comprising: at least one cross rod extending between said opposing side rods at a position spaced slightly forward of the rear rod.

16. The oven rack according to claim 1, wherein the food item support zone includes first and second food item support zone portions which are laterally spaced by the food item access zone.

17. A cooking appliance comprising:

an oven cavity having top, bottom, rear and side walls; and an oven rack supported along the side walls of the oven cavity, said oven rack including:

a frame portion including front, rear and opposing side rods, said front rod including first and second down-turned segments that are joined by a vertically offset portion; and a support platform including a first plurality of spaced support members and a second plurality of spaced support members which are configured different from the first plurality of spaced support members, each of the first and second plurality of spaced support members extending between and being fixed to the front and rear rods, with the second plurality of spaced support members extending through a bend portion that is spaced from said front rod directly to the vertically offset portion, to establish both a food item support zone and a food item access zone, said food item access zone being defined at the vertically offset portion to provide for exposure of a bottom portion of food item placed upon the rack for cooking in the oven cavity.

18. The cooking appliance according to claim 17, wherein the food item access zone is established vertically below a plane defined by the food item support zone.

19. The cooking appliance according to claim 17, wherein the front rod also includes first and second frontal segments arranged laterally outwardly of the vertical offset portion.

* * * * *